US006899083B2

(12) United States Patent
Djordjevic

(10) Patent No.: US 6,899,083 B2
(45) Date of Patent: May 31, 2005

(54) HYBRID DEMAND CONTROL FOR HYDRAULIC PUMP

(75) Inventor: Ilija Djordjevic, East Granby, CT (US)

(73) Assignee: Stanadyne Corporation, Windsor, CT (US)

( * ) Notice: Subject to any disclaimer, the term of this patent is extended or adjusted under 35 U.S.C. 154(b) by 0 days.

(21) Appl. No.: 10/477,246

(22) PCT Filed: Sep. 10, 2002

(86) PCT No.: PCT/US02/28685

§ 371 (c)(1),
(2), (4) Date: Nov. 10, 2003

(87) PCT Pub. No.: WO03/023232

PCT Pub. Date: Mar. 20, 2003

(65) Prior Publication Data

US 2004/0168674 A1 Sep. 2, 2004

Related U.S. Application Data

(60) Provisional application No. 60/318,375, filed on Sep. 10, 2001.

(51) Int. Cl.[7] ..... F02M 37/04
(52) U.S. Cl. ..... 123/446; 123/456
(58) Field of Search ..... 123/446, 456, 123/514, 506, 458, 357, 179.17, 462, 198 D

(56) References Cited

U.S. PATENT DOCUMENTS 4,719,889 A * 1/1988 Amann et al. ..... 123/447
4,884,545 A * 12/1989 Mathis ..... 123/447
5,109,822 A * 5/1992 Martin ..... 123/456
5,884,606 A * 3/1999 Kellner et al. ..... 123/446
6,095,118 A * 8/2000 Klinger et al. ..... 123/446
6,422,203 B1 * 7/2002 Djordjevic ..... 123/456

* cited by examiner

*Primary Examiner*—Carl S. Miller
(74) *Attorney, Agent, or Firm*—Alix, Yale & Ristas, LLP

(57) ABSTRACT

The invention is directed to the combination of fuel rail pressure control at lower speed using high pressure regulation plus fuel rail pressure control at higher speed using any of a variety of forms of inlet metering. The partial filing control at high speed can in one embodiment include pre-metering the quantity of feed fuel delivered to each pumping chamber, for example by modulating the feed pressure at the pumping chamber inlet. Another embodiment includes passing the feed fuel from the inlet passage through a fixed, calibrated orifice sized to pass sufficient feed fuel to fill the pumping chambers in the charging phase during operation of the engine in the low speed range, while in the high speed range the flow resistance of the orifice prevents the pumping chamber from filling in the charging phase, thereby monotonically decreasing the quantity of high pressure fuel delivered to the discharge passage in the discharge phase per engine revolution, with increasing speed above the transition speed.

21 Claims, 12 Drawing Sheets

HYBRID DEMAND CONTROL FOR HYDRAULIC PUMP

CROSS REFERENCE TO RELATED APPLICATIONS

This is the national stage of International Application No. PCT/US02/28685, filed Sep. 10, 2002, for which a claim to priority is made under 35 U.S.C. §119(e) from U.S. Provisional Application No. 60/318,375 filed Sep. 10, 2001.

BACKGROUND OF THE INVENTION

The present invention pertains to hydraulic pumps for delivering high-pressure fuel to common rail fuel injection systems for internal combustion engines.

A typical gasoline direct injection (GDI) pump is sized by the maximum fuel demand, which occurs at extremely cold starting conditions. This means that during 99% of pump operation, such a pump is highly oversized. The oversizing produces excess pressurized fuel and the problem arises as to handling the unwanted highly pressurized fuel. This has been one motivating factor for the development of so called "demand controlled" pumps.

With the automotive industry looking to increase common rail pressure to 200 bar or more, the weaknesses of current demand-based fuel control techniques are becoming even more evident. Currently, three mainstream methods of demand control are known:

1. High Pressure Bypass

Pressurized fuel is spilled (either at the pump or from the rail) back into the low pressure circuit (back to the tank or into pump inlet). This method provides very uniform pressure and low pulsation drive torque, but is very inefficient and also poses serious problems because of heat rejection.

Systems like these are successfully used today with pumps delivering up to 0.6 cm3/rev and up to 120 bar pressure, but any further pressure and/or output increase would require an additional fuel cooler in order to keep the temperature of the system components within acceptable levels.

2. Low Pressure Bypass

The pumping chamber is fully filled prior to each pumping event and the unwanted fuel quantity is spilled before high pressure is generated. This method is more efficient then the previous one and also results in far less heat rejection. However, with ever increasing demands for higher output and higher pressure level, the efficiency is likely to suffer and it also will present higher and higher technical challenges, to achieve the desired effect. A high speed, high flow and high force control solenoid is required and this means also a high power driver to control this solenoid will be required.

Another potential drawbacks of this approach is achieving adequate durability despite the very high number of working cycles over the expected vehicle lifetime.

3. Inlet Metering

This is by far the most efficient method, as only the desired amount of fuel is pressurized and because only low pressure fuel is controlled, a low power, slow control solenoid is satisfactory. However, this method has its own serious drawbacks.

(a) Uniformity of operation: At full output the pumping characteristic for a three plunger pump is relatively smooth. However, at part load, until the pumping events start to overlap, there will be three distinct pumping events per revolution. With six or more cylinder engines, the rail pressure for every other injection event will be lower than for the previous one, because the rail was not refilled in between and rail pressure determines ultimately the exact injection fuel quantity. A second issue regarding the pumping uniformity is the case when pre-metered fuel quantity is supplied into the charging circuit (for example by using typical MPFI gasoline injector). As charging conditions of all pumping chambers are not exactly identical (gravity, individual tolerances of orifices and clearances, friction, inlet check spring forces, distance from the solenoid etc.) the fuel quantity supplied by all three pumping events will not be identical. In the worse case at some small quantities, only one pumping event per revolution could take place.

(b) Hydraulic and acoustic noise: Because each pumping chamber is only partially filled prior to the injection, collapsing of vapor cavities will generate audible and hydraulic noise. Although under some circumstances when the pumping rate remains relatively low, this cavitation will not necessarily translate into erosion, the audible noise might pose a serious problem, especially at low speeds, for example at idle, when there are no other noises to mask (cover up) the noise generating by the pump and when the operator might be most sensitive as far as noise is concerned.

(c) Transients: Both ascending and descending transients will be delayed by at least 180 degrees of rotation from intention tot implementation time, because any change in desired output can only be implemented after the charging cycle is completed. This delay will negatively affect the smoothness of engine operation, especially at low speed, where 180 degrees translate into longer time. For example, at 3000 engine rpm the delay time would be about 20 ms, whereas at 200 rpm the delay time would be almost 300 ms. During ascending transients at least three injection events have to pass, before the increased injection quantity-takes place. During descending transient the pump will deliver more fuel than needed, resulting in a rail pressure increase up to the pressure limiter level setting. This will lead to higher than desired injection quantity when the fuel demand resumes. In a typical case, during the gear-shifting event, there is an instantaneous demand for zero fuel, as the driver repositions his foot from throttle to the clutch and back.

(d) Controllability: The inlet metering orifice has to be sized to insure maximum quantity of fuel at the maximum pump speed. Because the time available for charging at low speed is much longer, there will be a very small difference between the pulse width corresponding to wide open throttle (WOT) versus pulse width corresponding to almost zero load, making the control of the exact amount of fuel very difficult. This can be exemplified by the calculated output of a pump rated at 200 bar pressure, with 1000 mm3/rev displacement and 442 mm3/rev WOT, operating with conventional inlet metering via a proportional solenoid control. At 750 rpm the desired WOT fuel is achieved at 1% of the solenoid duty cycle, making control of any smaller fuel quantity, for example 10% WOT, virtually impossible. At 1300 rpm the duty cycle range required to control fuel quantity between zero and WOT, would be a more manageable 0 to 30%.

SUMMARY OF THE INVENTION

The object of the present invention is to provide a demand-based multi-plunger gasoline fuel supply pump, system and method for a common rail direct injection system operating at higher than conventional pressure, e.g., over 150 bar, especially 200 bar or more.

This is accomplished in the broadest sense, by a hybrid demand control system. From start up through intermediate speeds (for example from 100 startup to 2600 threshold or transition ERPM) the pump operates as an uncontrolled (constant output) pump, recirculating 100% of unwanted fuel through a dumping pressure regulator (located in the high pressure circuit). During speeds higher than the threshold (which for typical vehicle operation will occur during less than 10% of the total vehicle life) the control strategy switches into a flow restricted, e.g., inlet metering, mode. The intermediate transition speed would most likely be in the range of about 1000 to 2000 ERPM.

The broadest aspect of the present invention is thus directed to the combination of fuel rail pressure control at lower speed using high pressure regulation plus fuel rail pressure control at higher speed using any of a variety of forms of inlet metering. This inventive combination does not, however, preclude a further control technique at either extreme or for special circumstances.

The invention can be more particularly considered as a method of pumping fuel to the common rail at a rail target pressure, comprising the steps of (1) continuously delivering feed fuel at a low pressure, to an inlet port of the pump; (2) during operation of the engine in a low speed range below a transition speed, (a) (i) filling each pumping chamber during a charging phase, from the inlet passages in fluid communication with the inlet port, (ii) pressurizing the charged fuel in the pumping chambers by displacing the respective pistons during a discharge phase, and (iii) delivering the discharged fuel to a discharge passageway in fluid communication with the common rail, and (b) maintaining the rail target pressure by continually diverting at least some of the pressurized fuel in at least one of the discharge passage or the common rail, to a low pressure sink; and (3) during operation of the engine in a high-speed range above the transition speed, (c) (i) partially filling each pumping chamber during the charging phase, from said inlet passages, (ii) pressurizing the charged fuel in the pumping chambers by displacing the respective pistons during the discharge phase, and (iii) delivering the discharged fuel to the discharge passageway, and (d) maintaining the rail target pressure by continually diverting at least some of the pressurized fuel in at least one of the discharge passage or the common rail, to the low pressure sink.

The partial filing control at high speed can in one embodiment include pre-metering the quantity of feed fuel delivered to each pumping chamber, for example by modulating the feed pressure at the pumping chamber inlet.

Another embodiment includes passing the feed fuel from the inlet passage through a fixed, calibrated orifice sized to pass sufficient feed fuel to fill the pumping chambers in the charging phase during operation of the engine in the low speed range, while in the high speed range the flow resistance of the orifice prevents the pumping chamber from filling in the charging phase, thereby monotonically decreasing the quantity of high pressure fuel delivered to the discharge passage in the discharge phase per engine revolution, with increasing speed above the transition speed.

From another aspect, the invention is directed to a high pressure fuel supply pump for receiving fuel from a fuel tank at low feed pressure and discharging high pressure fuel to a common rail for delivery to an internal combustion engine having a plurality of combustion cylinders and a respective plurality of fuel injectors fluidly connected to the common rail for injecting fuel into the cylinders at the pressure of the common rail for operating the engine at speeds ranging from cranking speed to a maximum speed. The pump has a housing, a pump shaft situated within the housing, a plurality of radial pistons mounted for reciprocation in respective pumping chambers and for actuation by the engine at a pump speed proportional to the engine speed. An inlet port receives feed fuel at the feed pressure, and inlet passages fluidly connected between the inlet port and the pumping chambers delivers feed fuel to the pumping chambers during a charging phase of operation. A discharge port is provided for discharging high pressure fuel to the common rail, and discharge passageways are provided from the pumping chambers to the discharge port for delivering high pressure fuel from the pumping chambers during a pumping phase of operation. A pressure regulator for fluidly connecting the discharge passageways to the inlet passageways diverts at least some high pressure discharged fuel to low pressure feed fuel when the discharge pressure exceeds a limit value and maintains full discharge flow from the discharge passageways to the outlet port when the discharge pressure is below said limit value. Means situated between the inlet port and the pumping chambers, restricts the flow of feed fuel to the pumping chambers when the pump speed exceeds a predetermined threshold value.

In these embodiments and variations described and claimed herein, the quantity of pressurized fuel delivered to the common rail is more easily and reliably controllable commensurate with the demand over the full speed range, to a greater extent than is readily achievable with either one of a bypass control or a premetering control technique. As a result, the heat energy imparted to excess fuel by pressurization in the pumping chambers, is maintained at acceptable levels even as pump capacities increase.

In addition to the general inventive concept, the preferred embodiment, in the context of a multi-piston pump, contains four innovative features: (1) pressurized inlet sump to prevent formation of vapor cavities, (2) calibrated metering orifices in the pump pistons or plunger in order to better equalize the charging quantity among all the pumping chambers, (3) use of anti-cavity shuttle pistons for the pumping plungers, and (4) an accumulating, two step pressure limiting valve.

BRIEF DESCRIPTION OF THE DRAWINGS

An exemplary description of the invention is set forth below with reference to the accompanying drawings, in which.

DESCRIPTION OF THE INVENTION

Figure 1:
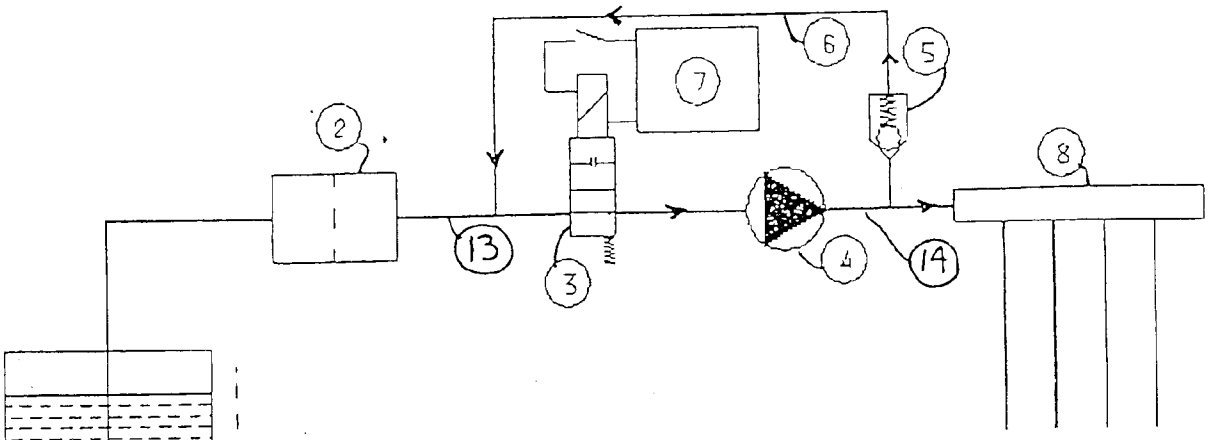
FIG. 1 is a schematic of the present invention, showing operation during startup to intermediate speed, with internally recycled excess fuel.
Figure 2:
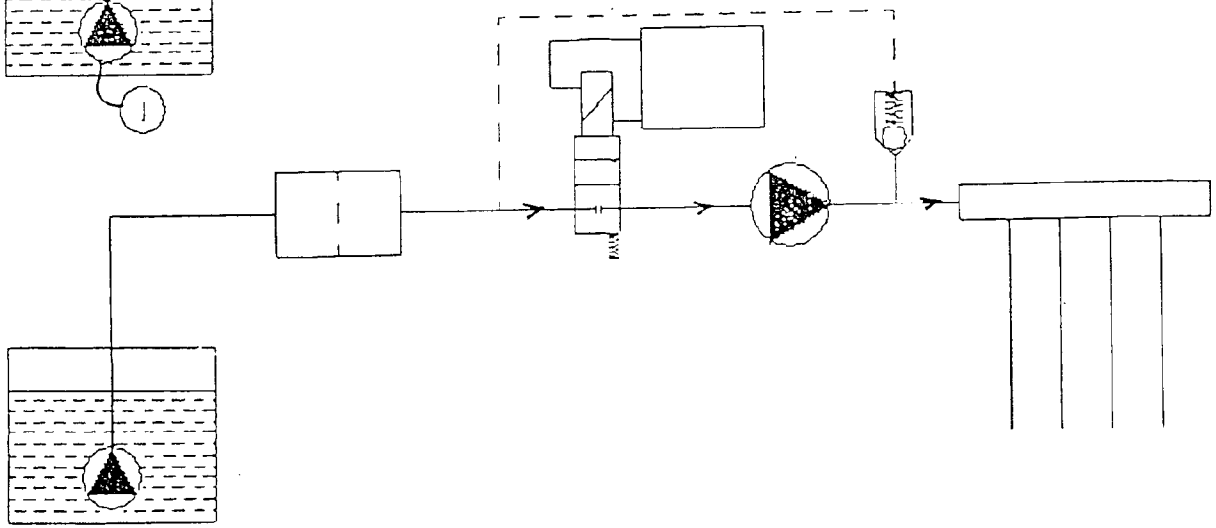
FIG. 2 is a schematic of the present invention, showing operation at speeds above those associated with FIG. 2, with inlet metering.
Figure 3:
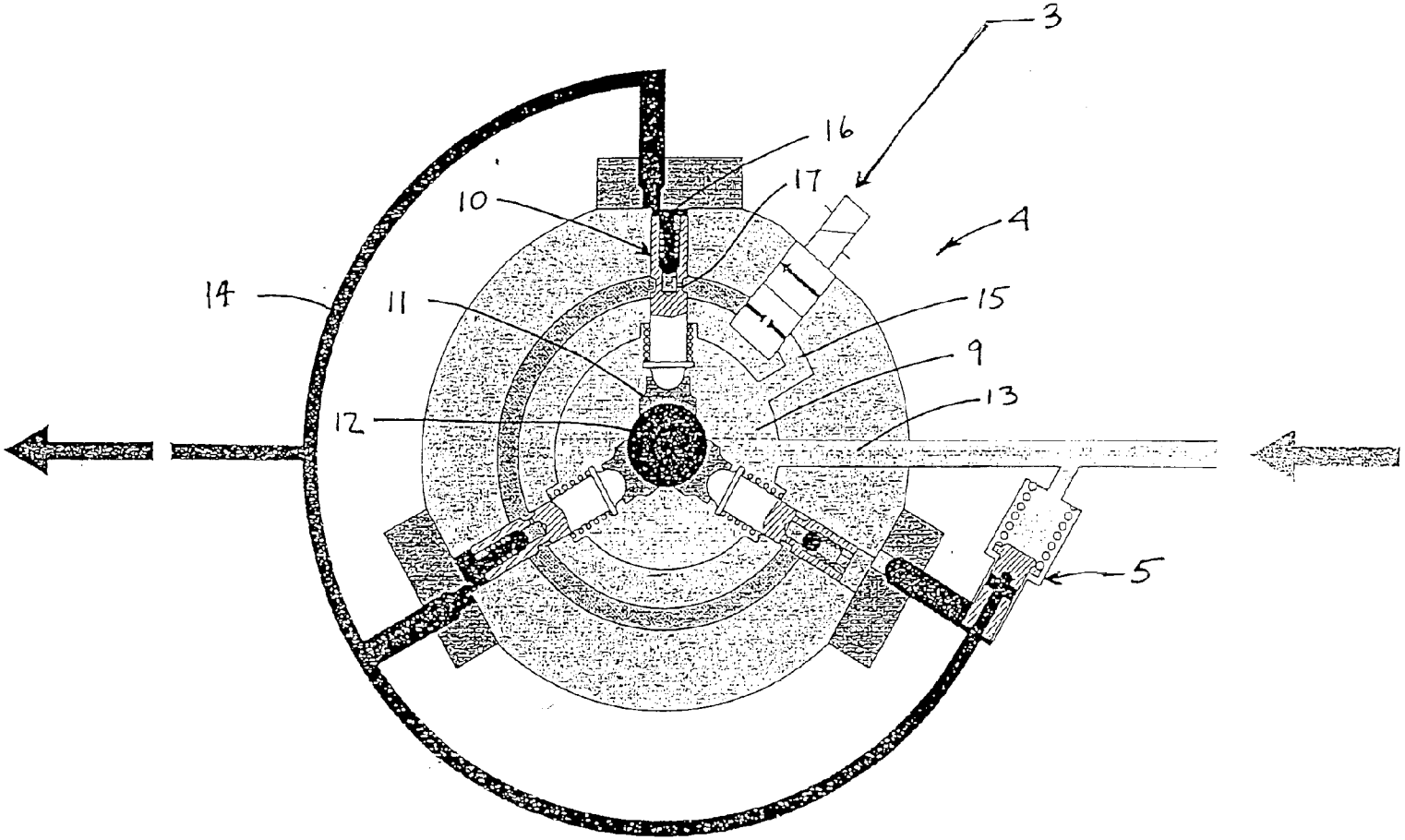
FIG. 3 is a hardware schematic of a first embodiment for implementing the inventive control strategy according to FIGS. 1 and 2.

The inventive fuel delivery and control system as depicted in FIGS. 1, 2, and 3 provides the advantages of all the above-described conventional techniques, while reducing or eliminating most of their drawbacks.

In overview, a low pressure (4–5 bar) feed pump 1 delivers fuel through filter 2 to an inlet metering valve 3 for the high speed operation of pump 4 in one mode of control, whereas in another mode for low speed operation, a rail pressure limiter 5 in a bypass line or circuit 6 permits unrestricted charging with full bypass above the limit pressure. The electronic control unit 7 controls the proportional solenoid for the metering valve 3. The pump 4 supplies high pressure fuel to the common rail 8, to which injectors are connected and controlled in a known manner.

For the constant pressure system depicted in FIG. 3, fuel supplied from the filter passes through low pressure inlet passage or circuit 13 and is fed unrestricted into the sump 9 defined within the high pressure pump 4. The pump includes three radially configured pumping plungers 10 which are driven via respective shoes 11, by a centrally located, rotating drive member 12 such as an eccentric coaxially connected to and driven by, e.g., a cam shaft. Each pumping plunger moves radially outwardly against a pumping chamber 16 defined in part by the pumping bore in which the plunger reciprocates. The high pressure discharge passes through the pumping chamber covers or plugs, into the high pressure line or circuit 14, for delivery to the rail 8.

The sump 9 preferably is a relatively large central cavity maintained at the feed pressure of 4–5 bar, in order to avoid the build up of vapor pockets, which could cause the sliding surfaces of the rear bushing as well as of the sliding shoes 11 to run partially under dry conditions, resulting in increased friction and heat generation. Vapor pockets also act as thermal insulation, inhibiting proper cooling of the above components and resulting in serious damage.

From the sump 9 the fuel is channeled into the inlet circuit 15 and the inlet circuit pressure is modulated downstream of the sump by a proportional control solenoid 3. This solenoid can be either normally open (with the advantage of short control duty cycles, but with the need for an additional safety dump valve) or normally closed (no safety dump, but longer control duty cycles). The pumping chambers 16 communicate with the control circuit downstream of the metering valve 3, via calibrated orifices 17 located laterally in the pumping pistons 10. These are calibrated to insure wide open fuel delivery at rated speed with certain safety margins and to assure substantially equal charging flow into each pumping chamber. In particular, placing these calibrated orifices in the piston itself will insure solid fuel upstream of those orifices (downstream will be a mixture of solid fuel and fuel vapor) and by that the flow through the orifices will be a function of orifice area and square root of pressure differential, resulting in uniform distribution among the individual pumping chambers.

Figure 4:
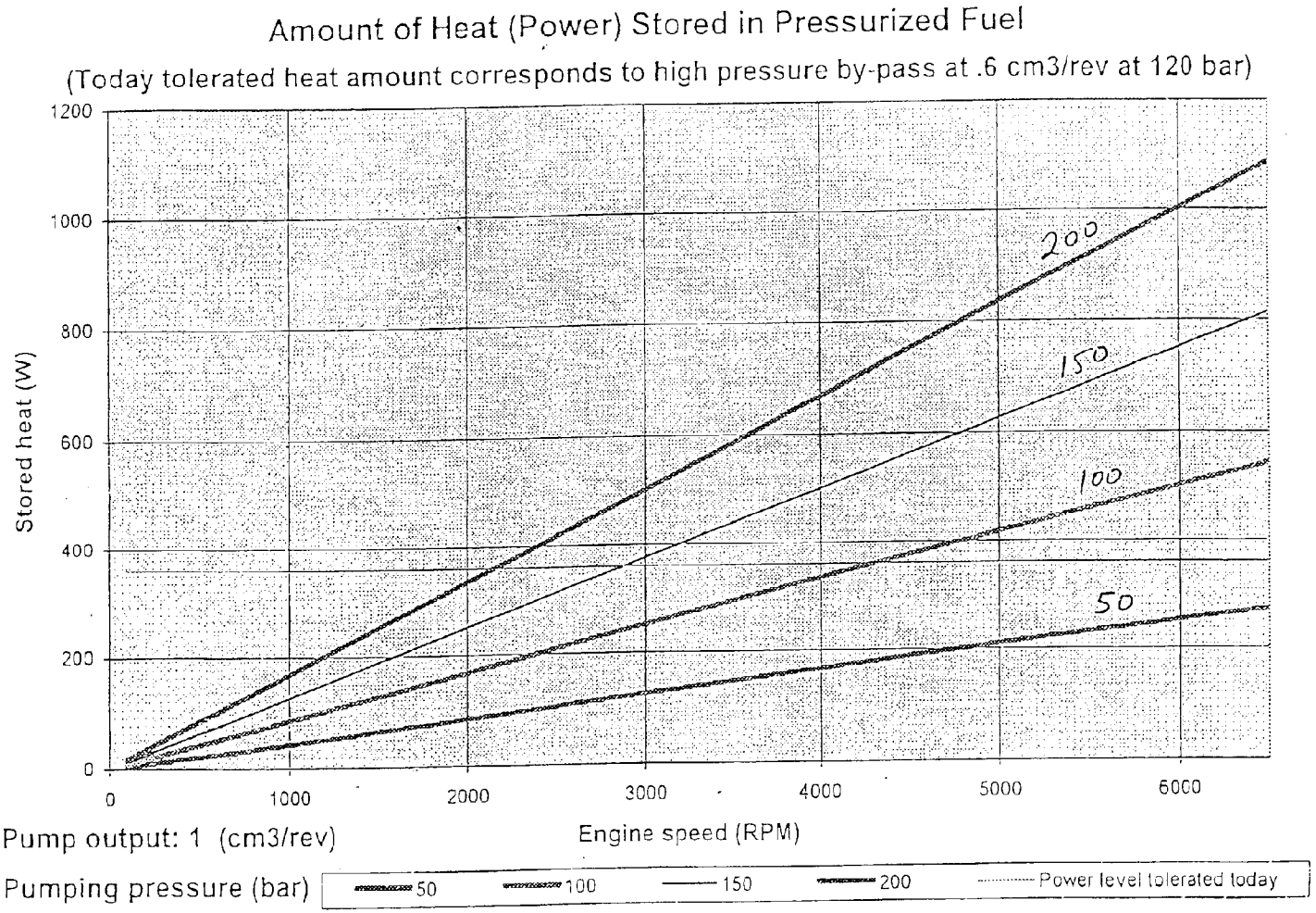
FIG. 4 is a graph showing the amount of heat (power) stored in pressurized fuel, at various operating conditions, superimposed on the maximum tolerated by current high pressure by-pass fuel control systems.

From start up to intermediate speeds (for example 100 to 2600 ERPM) the pump operates as an uncontrolled (constant output) pump, recirculating 100% of unwanted fuel through the integral dumping pressure regulator 5 (located in the high pressure circuit 14). Although there will be substantial heat generated that must be rejected, caused by continuous re-pressurization of the same fuel, as long the magnitude of the heat remains at or below the level experienced with current high pressure dump control systems, no problem will arise. This can be understood from FIG. 4, where this current maximum is shown as a constant at just under 400 W. For a pump producing 1.0 cm3/rev flow at 100bar, this limit is reached at about 4000 ERPM. However, for a desired pressure of 200 bar, the limit is reached slightly above over 2000 ERPM.

With the present invention, the high-pressure bypass/recycling mode is terminated at an engine speed low enough to avoid excessive heating of the fuel, e.g., at below about 3000 rpm. In practice for a 200 bar pump, this switching point can be up to about 2600 rpm. The acceptable dissipated power level with the present invention can be slightly higher than indicated in FIG. 4, because the fuel is recirculated internally in the pump and is not additionally heated by dwell in the very hot rail typically located above the engine cylinder head (the hottest engine component). During this mode of operation, the drive torque fluctuation and hydraulic and acoustic noise will be minimal.

During speeds higher then the threshold (which in a typical vehicle operation will occur during less then 10% of the total vehicle life) the control strategy switches into inlet metering mode. However the transient delay times as well as pumping non-uniformity and hydraulic and acoustic noise wilt be effectively masked, because of higher pumping frequency and higher environmental noise level. Because the solenoid valve 3 operates at a much lower pressure level (feed pressure of 4–5 bar vs. discharge pressure of 200 bar) and substantially slower duty cycle, the solenoid can be less costly and easier to control.

It can be appreciated that the solenoid control valve 3 can modulate the size of the flow aperture such that flow resistance of the aperture prevents the pumping chambers from filling in a charging phase. Alternatively, although not preferred, a discrete positional valve, having fully open and fully closed limits, could be utilized to modulate a time interval during which the aperture is open such that the charging flow quantity varies to prevent the pumping chamber from filling in the charging phase.

Preferably, an accumulating type dumping pressure regulator 5 is used, allowing for overall pump output reduction. The regulator has a front side exposed to the discharge line or rail pressure and a back side exposed to the inlet port or feed pressure. The pump output of a system operating at constant pressure level, for example 200 bar, is actually sized by the pumping rate, rather then by cumulative pump output. The flow parameters of the injector and the injection duration are determined by operating conditions at the highest speed (for example maximum duration 2 to 3 milliseconds). Because of limited accumulating capacity of the rail the pump will effectively operate as an injection pump, rather than as a supply pump. The short actuation times are also applied during low speeds, but at low speed this short time translates into very few pumping degrees so the pumping rate has to be increased correspondingly to prevent pressure collapse during the injection. The disparity between the pumping rate and injection rate is more pronounced the lower the engine speed, especially during cold starting conditions, when in addition to high fuel requirements the cranking speed could be very low because of lower than required battery voltage.

Figure 5:
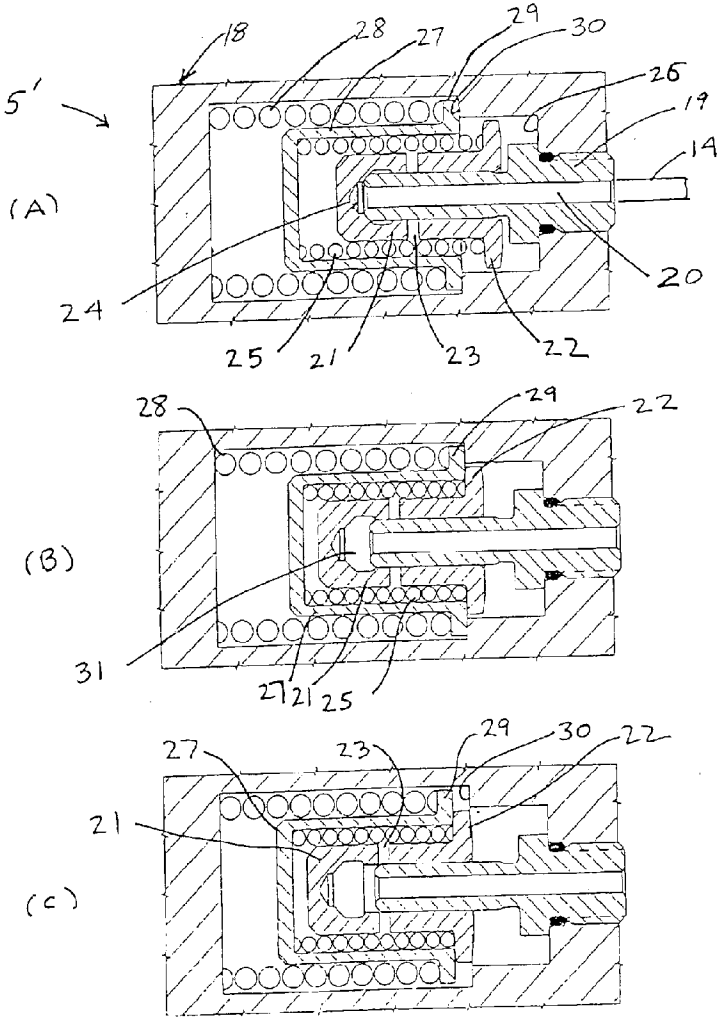
FIGS. 5 (A), (B), and (C) are a schematics showing the operation of a two-step pressure limiter and accumulator.

FIG. 5 is a schematic of a preferred, two-step hydro/mechanical pressure limiter and accumulator 5'. The two step accumulator is shown in the nominal condition in FIG. 5A. The first active position, shown in FIG. 5B, occurs at a pressure between 40 and 70 bar which is sufficient for cranking and the second active position shown in FIG. 5C, occurs at pressure between 150 and 200 bar. The relatively large flow area of the dumping ports produces a pressure characteristic that is relatively flat across the entire speed range. Pressure transients resulting from small excess quantities of pumped fuel are absorbed within the accumulator volume without fluid transfer through the back side of the valve, and pressure transients resulting from large excess quantities of pumped fuel are relieved by exposure to the low pressure sink of the inlet port.

In particular, body 18 has an elongated stem fitting 19 rigidly secured at the end 26 of the body exposed to the high pressure circuit 14. The stem has a central bore 20 with open front end within the body. An inner cylinder 21 is mounted on the stem which serves as a pilot for inner spring 25. The coil spring 25 seats at one end against flange 22 formed on cylinder 21 and at the other end against the closed inner face of intermediate cylinder 27. The inner front region of inner cylinder 21 has a concavity 24 formed therein, which is exposed to the fuel pressure in circuit 14. The inner cylinder also has radial ports 23 intermediate the flange 22 and the cavity 24. The intermediate cylinder 27 has a flange 29 that bears on shoulder 30 formed in body 18, due to the influence of outer coil spring 28 seated at one end against flange 29 and at the other end against the back wall of body 18.

In the configuration shown in FIG. 5B, the pressure in bore 20 has displaced inner cylinder 21 to the left, against the influence of inner spring 25, until the flange 22 abuts flange 29 and cannot move farther against the influence of spring 28. This opens up cavity 31. In the configuration of FIG. 5C, further pressure has acted on inner cylinder 21 such that flange 22 displaces intermediate cylinder 27 away from the shoulder 30, exposing port 23 to the pressure in cavity 31.

Figure 6:
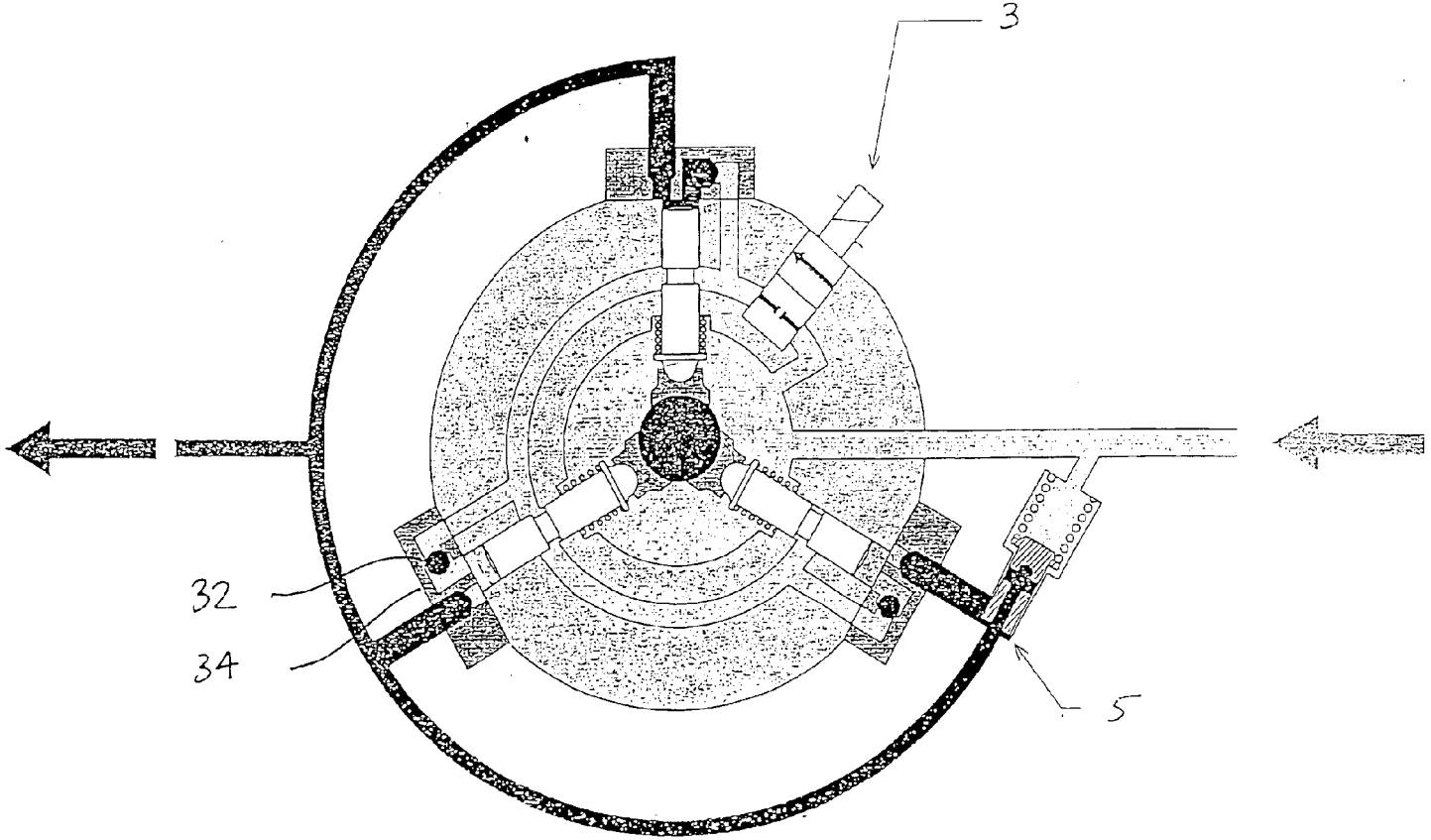
FIG. 6 is a hardware schematic of a second embodiment for implementing the inventive control strategy according to FIGS. 1 and 2.

FIG. 6 shows a variation of the system, shown in FIG. 3, wherein the charging occurs through inlet valves 32 in the pumping chamber cover 34, rather than through the lateral orifices in the piston cylinder walls.

Figure 7:
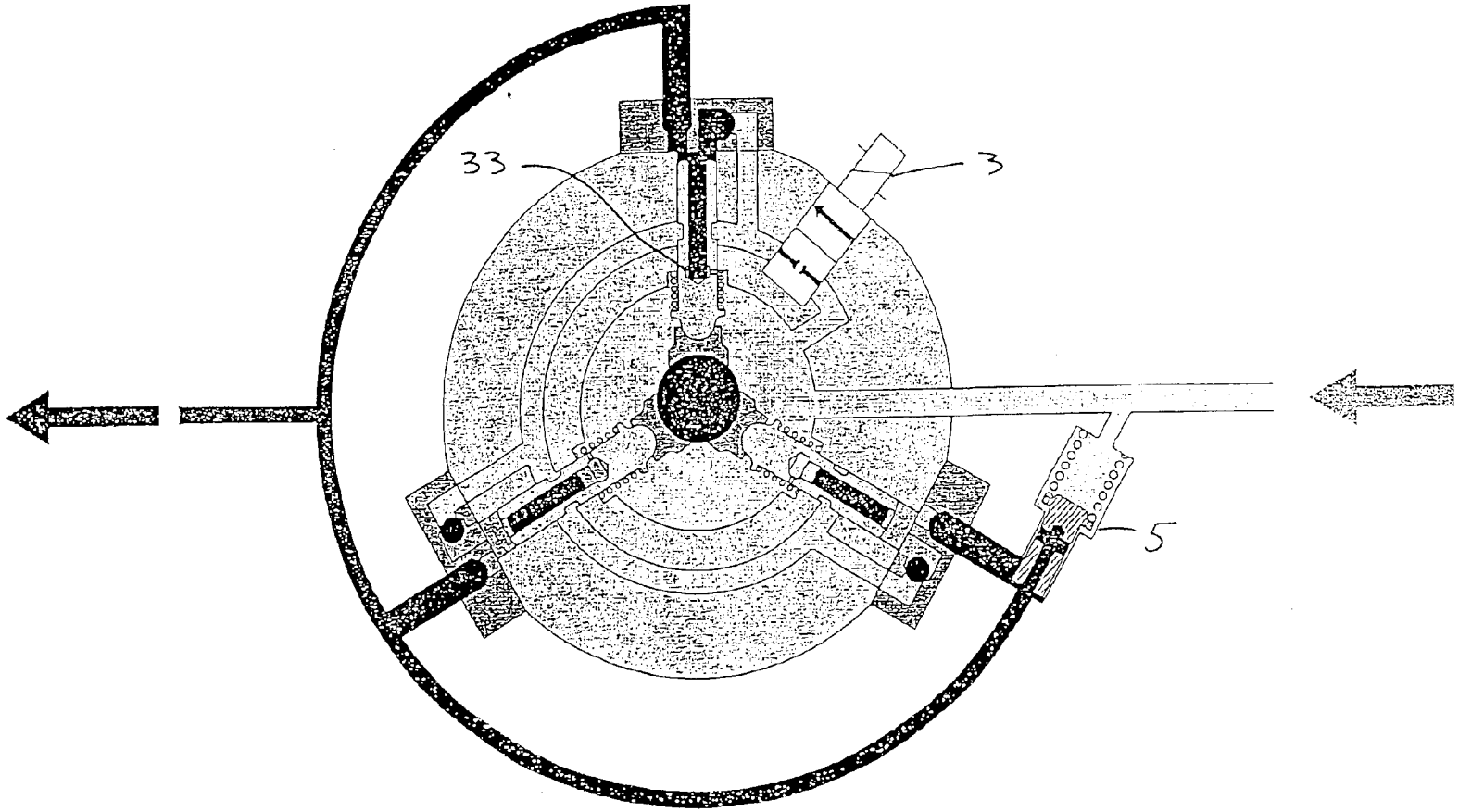
FIG. 7 is a hardware schematic of a third embodiment for implementing the inventive control strategy according to FIGS. 1 and 2.
Figure 8:
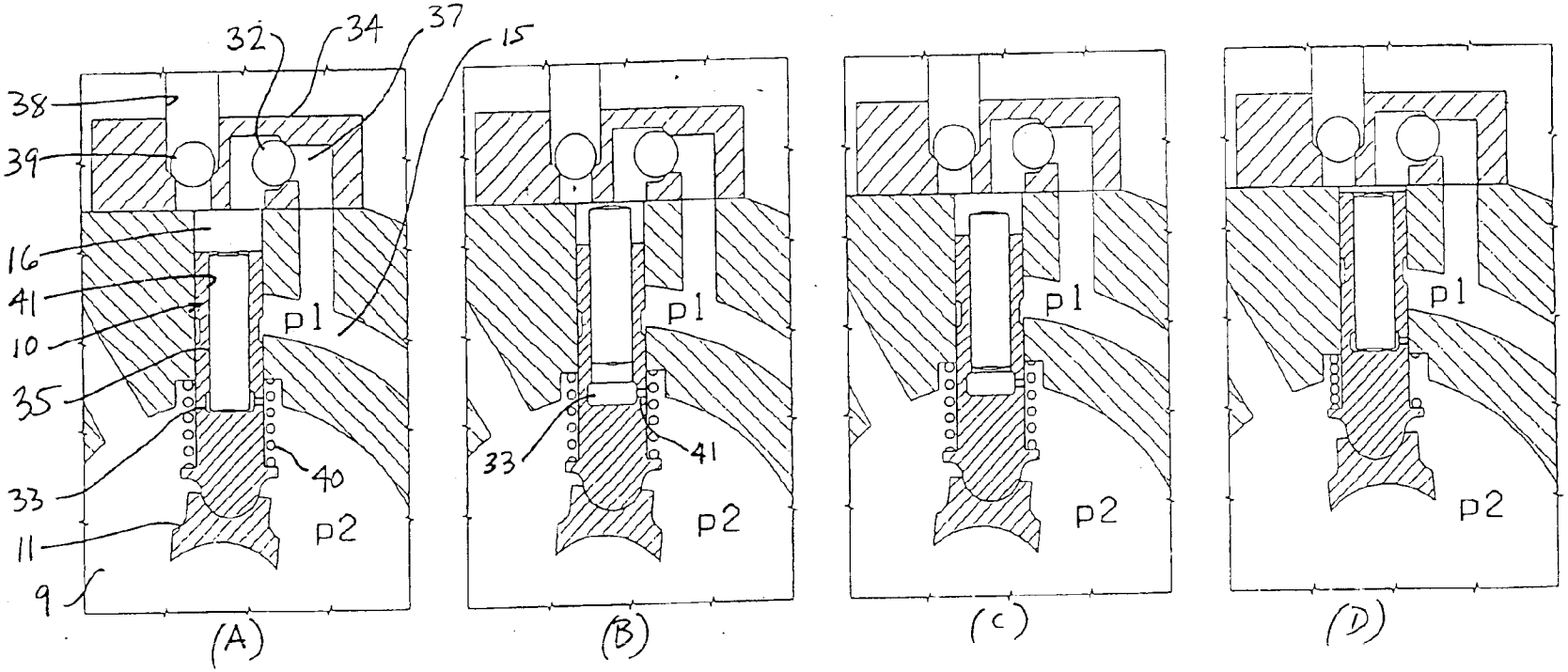
FIG. 8 is a more detailed schematic for implementing the embodiment of FIG. 7.

FIGS. 7 and 8 show another embodiment based on FIG. 6 but for operating at generally higher pumping rates, where cavitation erosion could occur. An anti-cavitation chamber 33 inside of each pumping plunger or piston prevents cavitation. A coaxial cylindrical cavity 41 and a loose pin 35 form this anti-cavitation chamber. During the charging event this anti-cavitation chamber as well as the main pumping chamber are both fully filled to a degree depending on the relationship between sump pressure P2 and modulated charging pressure P1. Before the high pumping pressure can be generated, the fuel trapped in the anti-cavitation chamber 33 has to be expelled, effectively damping the impact, noise.

FIG. 8A shows this arrangement in greater detail, when the piston or plunger 10 is at the bottom dead center position and the pin 35 is fully retracted. The pressure P1 in the inlet circuit or inlet passage way 15 (down stream of the high speed pressure modulating member) is in this circumstance equal to the pressure P2 in the sump 9, i.e., the feed inlet pressure. The pumping chamber cover 34 includes an auxiliary passage 37 that is fluidly connected to the inlet passage way 15, and selectively fluidly connectable via the check valve 32, to the pumping chamber 16.

The pumping chamber cover 34 also has a discharge passage 38 with associated discharge check valve 39 that is fluidly connected to the high pressure discharge circuit 14 (see FIG. 3). The plunger assembly 10 is in the bottom dead center position, due to the low pressure in the pumping chamber 16 and the retraction force generated by the return spring 40, which urges the piston and associated shoe 11 against the drive member surface, which at this time is at the maximum distance from the pumping chamber 16. FIG. 8B shows the subsequent condition wherein the plunger 10 is still in the bottom dead center position but the pin 35 is at the maximum extended position. In this situation, pressure P1 is much less than pressure P2. As a result, fluid from cavity 9 at pressure P2 enters the anti-cavitation chamber 33 through orifice 41 in the wall of the piston cylinder. In FIG. 8C, the plunger 10 is still in the bottom dead center position, but the pin is approximately half way between the fully retracted and fully extended positions, with the pressure P1 being slightly less than the pressure P2. FIG. 8D shows the plunger at the top dead center position, with the pin fully retracted.

As one of ordinary skill would readily understand, the pumping chamber 16 expands during the charging phase of operation, producing a relatively low pressure therein which open valve 32 whereby flow from the feed passage 15 pressure at P1 enters the pumping chamber 16. During the discharge phase of operation, the plunger 10 contracts the pumping chamber 16 thereby pressurizing the fuel, closing valve 32, and opening valve 39 for delivering high pressure fuel via path 38 to the high pressure circuit 14.

The plunger 10 has a coaxial cylindrical cavity 41 that is open at the radially outer, or pumping end of the plunger. Anti-cavitation chamber 33 is formed within the plunger between the pumping and the driven end. The pin 35 is situated within and can move relatively to the cylindrical cavity 41, from the position shown in FIG. 8A, where the pin is preferably fully retained within the plunger, with the inner end bearing on the rigid surface of the cavity transverse wall, thereby occupying most of the cavity volume, to the fully extended position shown in FIG. 8B, where the radially outer portion of the pin occupies a significant volume of the pumping chamber, and none of the volume of the anti-cavitation chamber 33.

Figure 9:
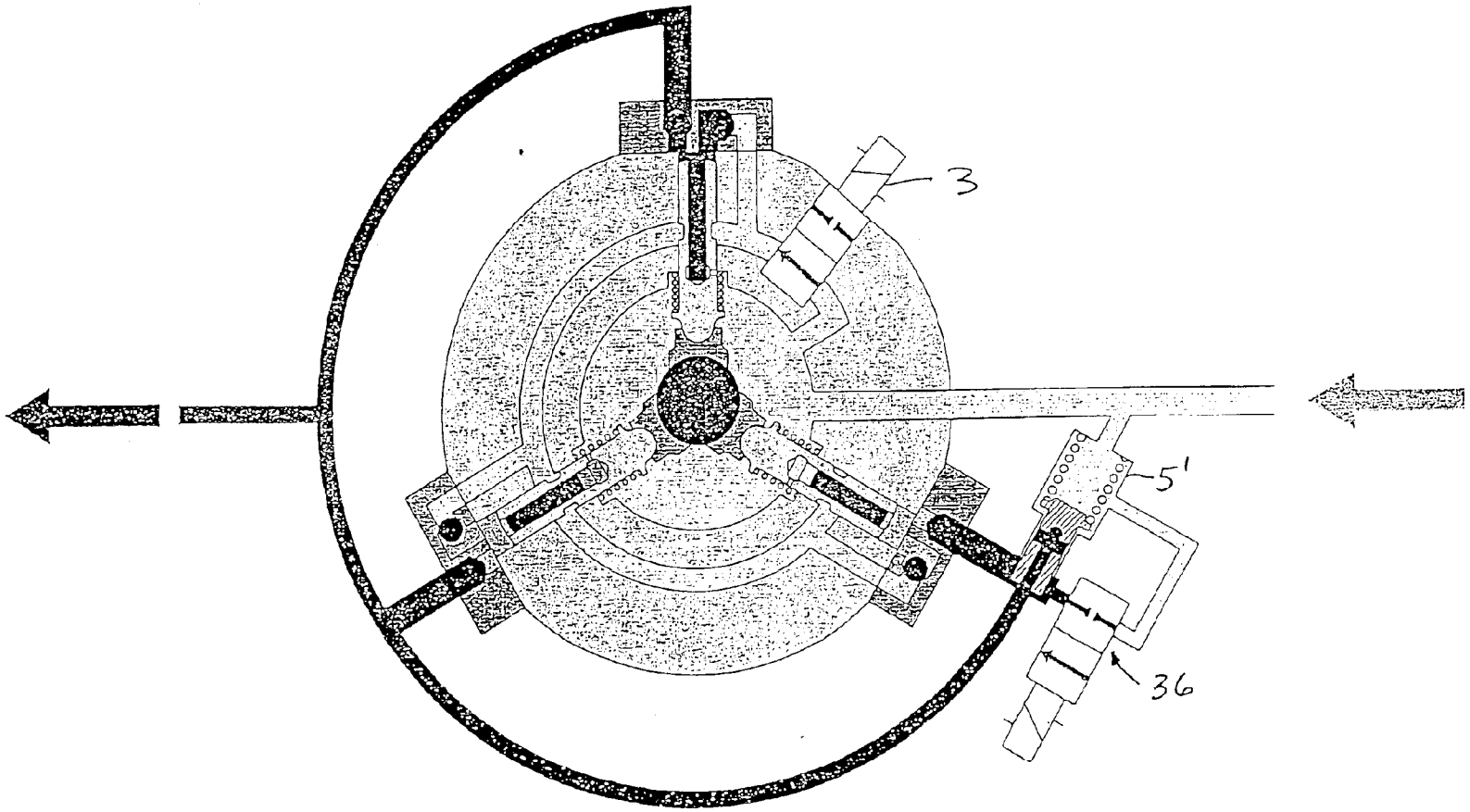
FIG. 9 is hardware schematic of a fourth embodiment for implementing the inventive concept of FIGS. 1 and 2.

FIG. 9 shows a system in which injection pressure modulation is required. In addition to the hydro-mechanical pressure limiter/accumulator such as 5' shown in FIG. 5, there is also another proportional valve 36, used to control the rail pressure when lower pressure than set by the pressure limiter 5' is required. Thus, the differential pressure at which the pressure limiting valve 5' opens, can be electronically controlled according to whatever algorithm the vehicle manufacturer wishes to implement in a variable common rail pressure fuel delivery system. The proportional solenoid valve 36 has an upstream side exposed to the rail pressure, and a backside exposed to the feed pressure, either by direct connection to the inlet passage ways or the inlet port, or by fluid connection to the back (low pressure) side of the pressure limiting valve 5'.

Figure 10:
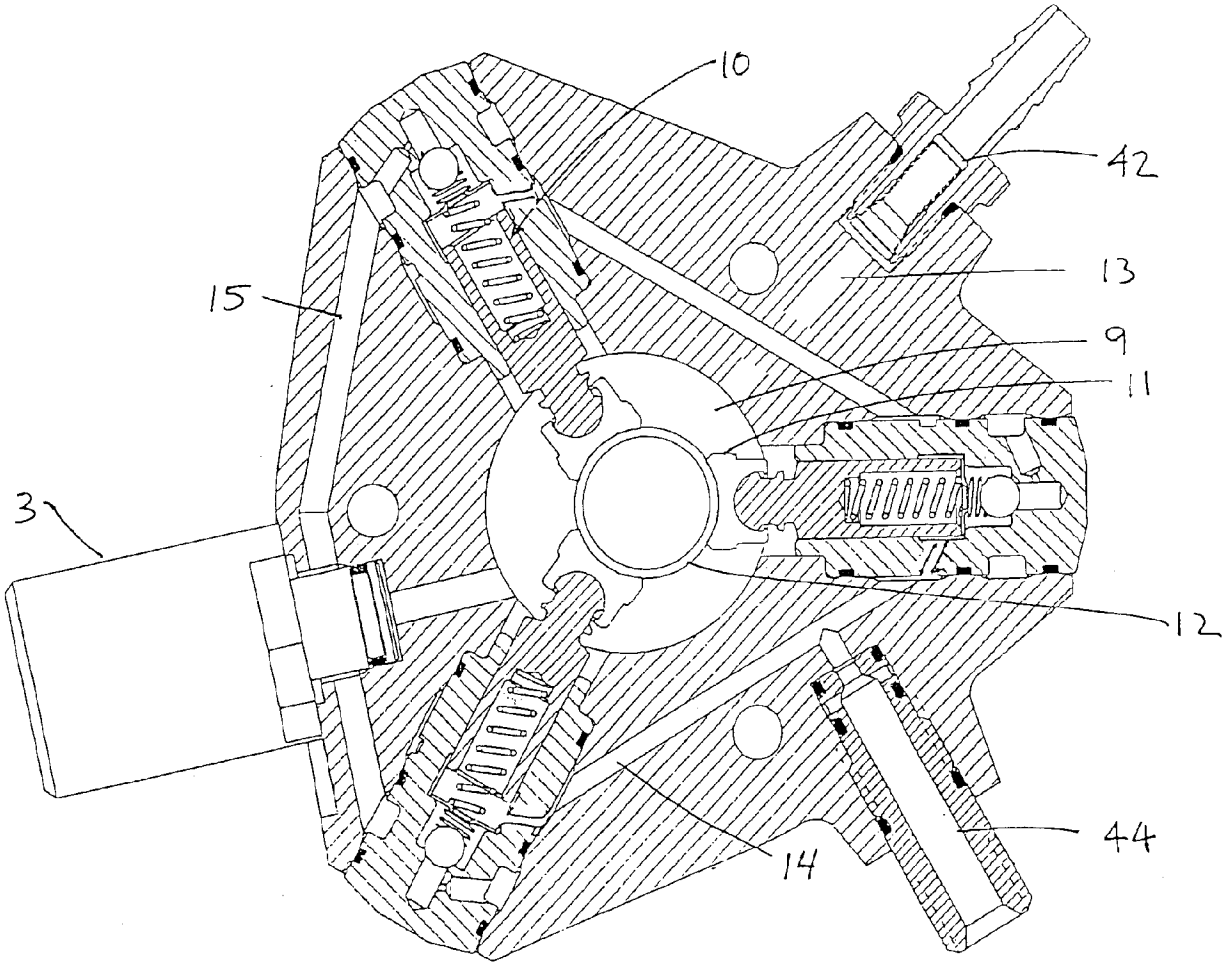
FIG. 10 is a more detailed schematic for implementing the embodiment of FIG. 3.

FIG. 10 shows one streamlined hardware execution of a system corresponding to the embodiments of FIGS. 3 and 6. In this view, the inlet port 42 is typically defined by a threaded fitting, and likewise the outlet port 44 is similarly define by a separate and distinct fitting, fluidly connected to the inlet circuit 13 and the high pressure circuit 14, respectively. Although the general concepts of the invention as disclosed in FIGS. 1 and 2, and shown schematically in FIGS. 3, 6, and 7 can be implemented with both the high pressure and low pressure control valves outside the pump proper, the preferred implementation is as shown in FIG. 10, where these valves are directly connected to the pump, and thus deemed integral therewith. (In the plane shown in FIG. 10, the conventional or improved pressure regulator 5, 5' is not visible).

Figure 11:
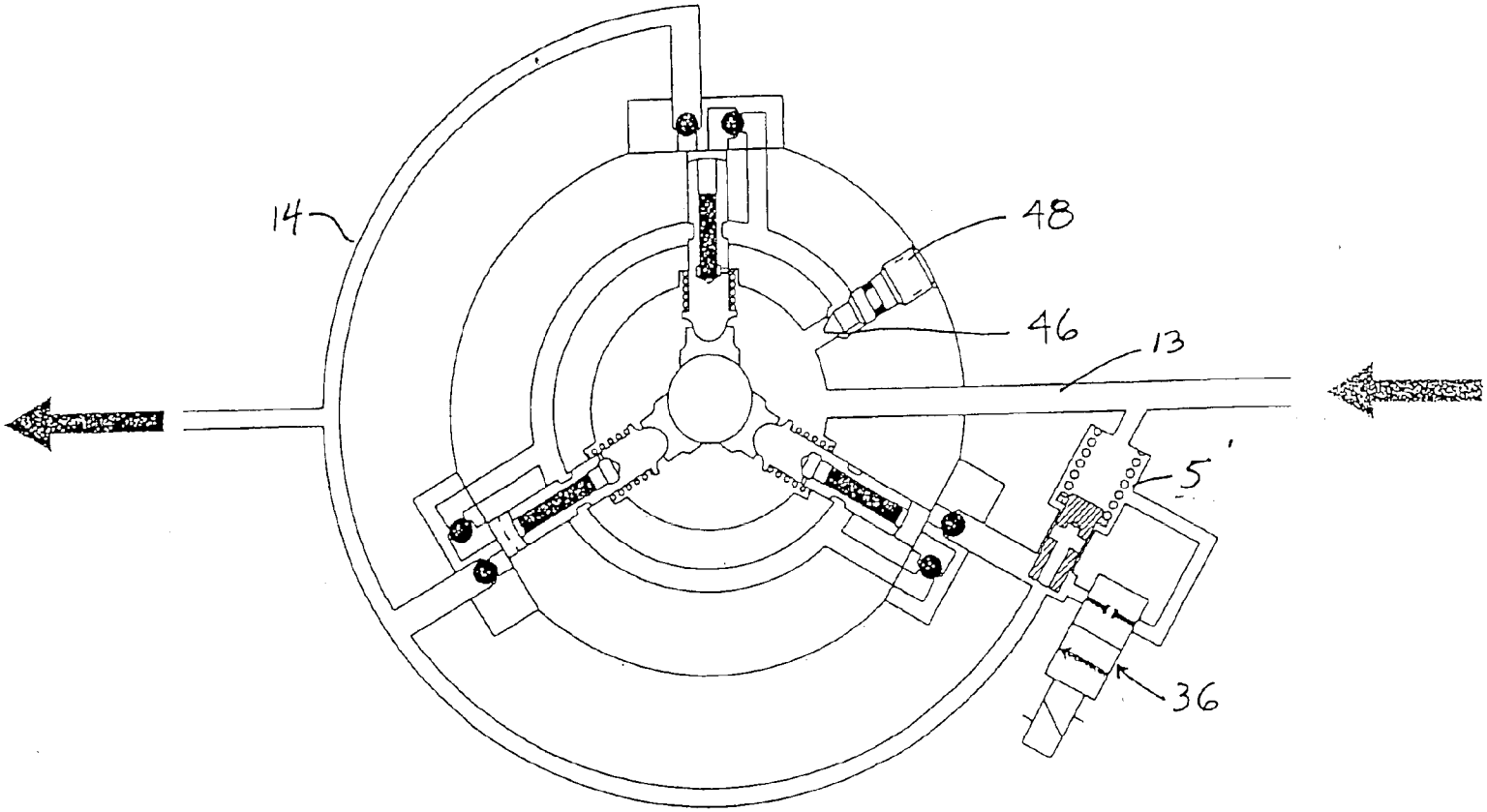
FIG. 11 shows another embodiment of the invention, according to which the inlet metering is performed by an adjustable flow restriction, rather than the proportional or other actively controlled valve such as described with respect to FIGS. 3, 7, and 9.

FIG. 11 shows another embodiment of the invention, according to which the inlet metering is performed by an adjustable flow restriction 46, rather than the proportional or other actively controlled valve such as described with respect to FIGS. 3, 7, and 9. According to this embodiment, a calibrated flow restriction in the pumping chamber feed passage 15 limits the maximum flow through the orifice 46 to be slightly above the maximum power point. In particular, the feed fuel is passed through the orifice such that flow resistance of the orifice prevents the pumping chamber from filling in the charging phase, thereby monotonically decreasing the quantity of high pressure fuel delivered to the discharge passage in the discharge phase per engine revolution, with increasing speed above a chosen transition speed.

The orifice is preferably adjustable, via a screw 48 or the like, to provide calibration during pump manufacturing or set up, but is otherwise not controlled during operation. For example, during qualification benched testing of each pump, the pump is operated at rated speed. The orifice is adjusted until the initially higher output is reduced to the desired level. This desired level can correspond exactly to WOT delivery or it can include some safety margin for future wear or to compensate for individual fuel and engine power variations. In particular, the supply pump will have a maximum quantity delivery rate per engine revolution, corresponding to full filling of the pumping chambers. The engine has a maximum speed corresponding to wide open throttle (WOT) and a fuel quantity demand per engine revolution corresponding to WOT, that is less than the pump maximum delivery rate per engine revolution. The orifice is calibrated such that the quantity of high pressure fuel discharged into the discharge passage per engine revolution at the maximum engine speed, is greater than the fuel quantity demand per engine revolution corresponding to WOT, but considerably lower than the pump maximum quantity delivery rate. A practical reduction in delivery rate would be in the range of 25%–50%, e.g., the reduced rate would be no greater than about 75% of the pump maximum quantity delivery rate per engine revolution. Alternatively, this calibration could be performed at the factory where the vehicle engine is assembled and tested.

Moreover, in a manner similar to the way carburetors were adjusted in the past, the orifice could be adjusted to equalize or limit the engine power. In any event, after the calibration is performed, the orifice adjusting screw can be sealed or otherwise tamper proofed to prevent unauthorized readjustment later on.

As shown in FIGS. 3, 6, 7, 9, 10, and 11, the pumping chamber are all exposed to the feed fuel in parallel relation to the inlet passage 15 downstream of a pressure modulation means 3, 48 which is in series relation with the cavity 9 or inlet port. Thus, the effect of the modulation means is manifested simultaneously and uniformly at the inlet to each pumping chamber.

As with the previously described embodiments, the embodiment shown in FIG. 11 can be modified for implementation in a variable pressure pump, by incorporating the proportional solenoid such as 36 shown in FIG. 9. This is preferably integrated within the pump, plumbed in parallel to the hydro-mechanical pressure limiter 5. Thus, the solenoid 36 can override the hydro-mechanical pressure limiter/regulator 5 and set the rail pressure at any desired lower pressure level, either to optimize the hydraulics of the injection or the better respond to an emergency. The integrated proportional solenoid valve is preferred over a rail mounted pressure controlled valve because of greater simplicity (no separate return line is required) and also because the temperature of internally recirculated fuel is slightly lower because the fuel does not pass through or adjacent hot spots at the exterior of the engine head.

As noted above, the transition speed, at which the control passes from relatively lower speed, fully charged with high pressure bypass control, to the higher speed, restricted charging mode, would typically occur in a speed range of between about 2000 and 3000 erpm. With the embodiments of FIGS. 3, 7, and 9, having the electronically controlled inlet orifice, the transient speed can be arbitrarily selected. With the embodiment of FIG. 11, however, the restricted feed orifice, once fixed in size, will establish the transition speed and will be based on the maximum speed setting. The overall efficiency of a system with electronically controlled inlet orifice is better, as the amount of fuel delivered by the pump can be matched more closely to the desired output. However, because typically the engine will operate at the higher speeds for less than 10% of its operational time, the hardware and control strategy associated with an electronically controlled inlet orifice may not always be cost effective.

Figure 12:
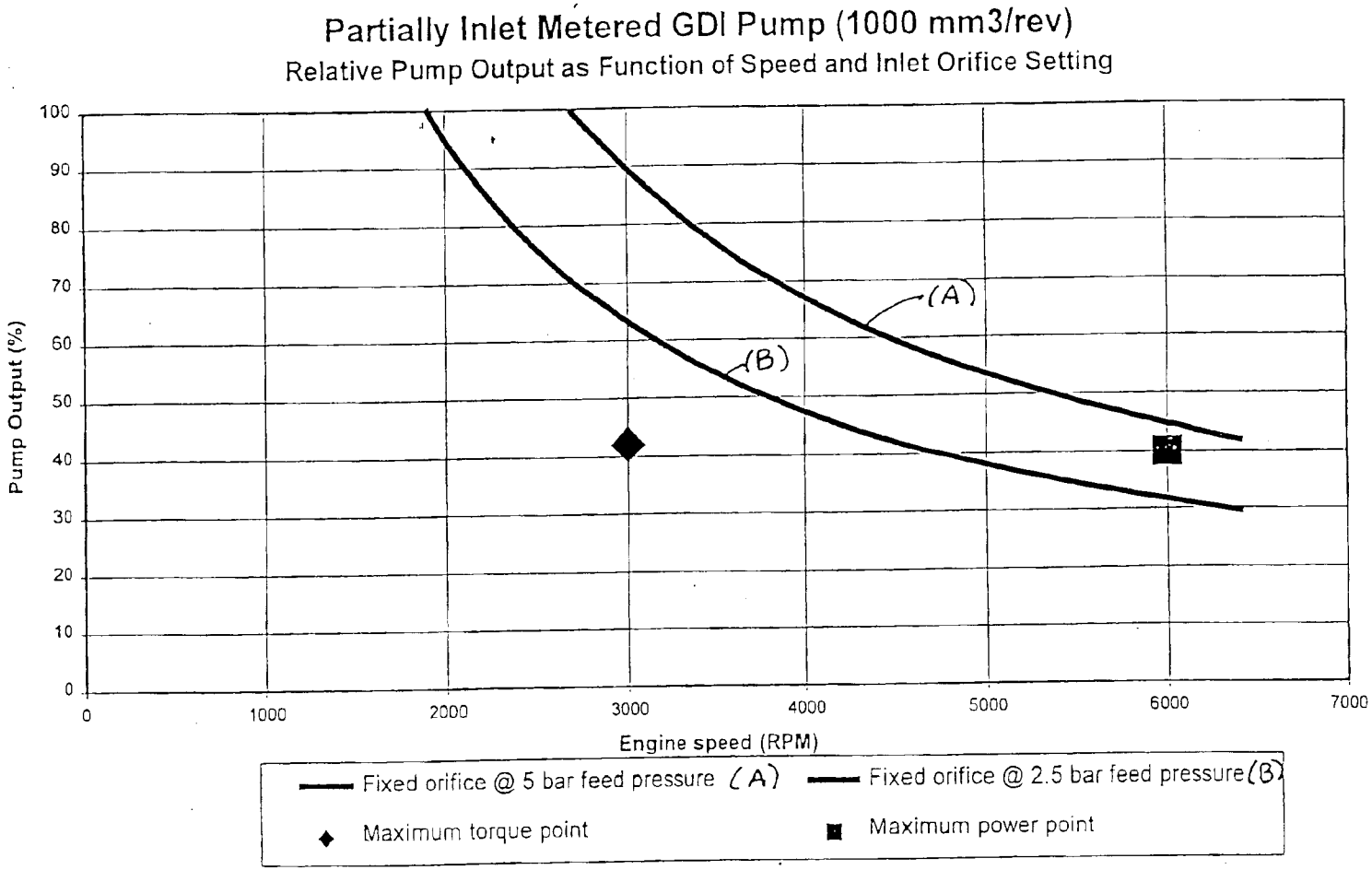
FIG. 12 shows the pump output for the relatively higher engine speed controlled regime (inlet pressure modulation) for a prototypical pump having a capacity of 1000 mm3/rev, for the same fixed calibrated inlet orifice but at two constant feed pressures of 5 bar and 2.5 bar.

FIG. 12 shows the pump output for the relatively higher engine speed controlled regime (pressure inlet metering) for a prototypical pump having a capacity of 1000 mm3/rev, for the same fixed orifice but at two constant feed pressures of 5 bar and 2.5 bar. Typically, the feed pressure would be 5 bar, corresponding to the upper curve in FIG. 12. For the condition corresponding to wide open throttle (6000 ERPM) the ideal pump output would be 40 percent (400 mm3/rev), but the orifice is calibrated to provide a slightly higher output (approximately 450 mm3/rev). At 3000 ERPM, because of typical orifice flow characteristics, the pump output will be 90 percent (900 mm3/rev), but only about 420 mm3/rev is required to achieve the maximum torque.

As noted above, with the electronic inlet control of the embodiments of FIGS. 3, 7, and 9, the output can be more closely matched to the output needed for peak torque. However, as further shown in FIG. 12, even with a fixed calibrated orifice providing the restricted inlet metering, additional control of the pump output at intermediate speed can be achieved by modulating the feed pressure. Thus, at very high engine speed, for example over 4500 ERPM, the feed pressure can be maintained at 5 bar (corresponding to the top curve in FIG. 12), whereas for speeds between, for example 2000 ERPM and 4500 ERPM, the feed pressure can be reduced (for example to 2.5 bar), thereby providing a pump output corresponding to the lower curve in FIG. 12. In this manner, the pump output in mid speed range can more closely correspond to the output needed at the maximum torque point.

Figure 13:
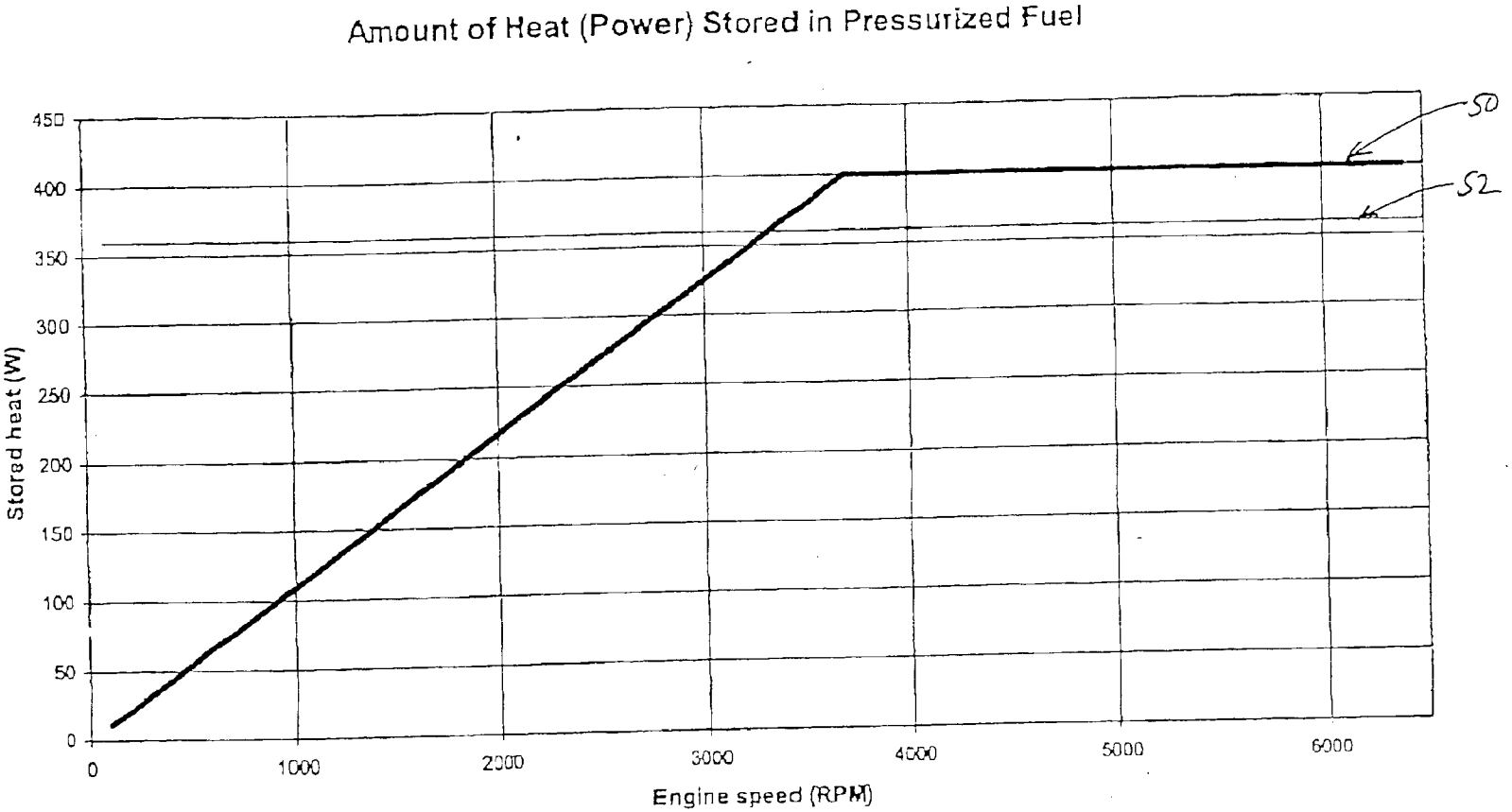
FIG. 13 shows the heat generation for a pump rated at 200 bar with the restricted charging control scheme according to the invention implemented at an engine speed up to 3800 rpm compared to that of a 120 bar pump with simple high pressure by-pass.

With reference again to FIG. 4, it can be appreciated that a pump designed according to the present invention for a given pressure operation selected from, for example 100, 150, or 200 bar, can operate with unrestricted charging in the range of about 2000–4000 ERPM while generating stored heat below about 4000 watts, but by implementing the restricted charging technique at an appropriate higher speed, the designer can thus "flatten" the heat generation curve to maintain a maximum heat generation with appropriate margin. An example is shown in FIG. 13, for a pump rated at 200 bar with the restricted charging control scheme 50 implemented at an engine speed up to about 3800 rpm, compared to that of a 120 bar pump with simple high pressure bypass regulation 52.

What is claimed is:

1. In a high pressure common rail fuel supply system for delivering fuel to an internal combustion engine having a plurality of combustion cylinders and a respective plurality of fuel injectors fluidly connected to the common rail for injecting fuel into the cylinders at the pressure of the common rail for operating the engine at speeds ranging from cranking speed to a maximum speed, the system including a high pressure fuel supply pump with radial pistons reciprocating in pumping chambers and driven by the engine at a pump speed proportional to the engine speed, a method of pumping fuel to the common rail at a rail target pressure, comprising:

continuously delivering feed fuel at a low pressure, to an inlet port of the pump;

during operation of the engine in a low speed range below a transition speed, (a) (1) filling each pumping chamber during a charging phase, from inlet passages in fluid communication with the inlet port, (2) pressurizing the charged fuel in the pumping chambers by displacing the respective pistons during a discharge phase, and (3) delivering the discharged fuel to a discharge passageway in fluid communication with the common rail, and (b) maintaining the rail target pressure by continually diverting at least some of the pressurized fuel in at least one of the discharge passage or the common rail, to a low pressure sink;

during operation of the engine in a high-speed range above the transition speed, (c) (1) partially filling each pumping chamber during the charging phase, from said inlet passages, (2) pressurizing the charged fuel in the pumping chambers by displacing the respective pistons during the discharge phase, and (3) delivering the discharged fuel to the discharge passageway, and (d) maintaining the rail target pressure by continually diverting at least some of the pressurized fuel in at least one of the discharge passage or the common rail, to the low pressure sink.

2. The method of claim 1, wherein the step (c) (1) includes pre-metering the quantity of feed fuel delivered to each pumping chamber.

3. The method of claim 2, wherein the pre-metering is performed by an electronically operated valve.

4. The method of claim 3, wherein the pre-metering is performed by a proportional solenoid valve.

5. The method of claim 1, wherein the step (c) (1) includes controlling the quantity of low pressure fuel delivered to each pumping chamber by modulating a proportional solenoid valve.

6. The method of claim 2, wherein the step (a) (1) includes passing the feed fuel from the inlet port through an unrestricted aperture sized to pass sufficient feed fuel through the inlet passages to fill the pumping chambers in the charging phase during operation of the engine in the low speed range, and the step (c) (1) includes modulating the size of the aperture such that flow resistance of the aperture prevents the pumping chambers from filling in the charging phase, thereby decreasing the quantity of high pressure fuel delivered to the discharge passage in the discharge phase per engine revolution, with increasing speed above said transition.

7. The method of claim 2, wherein the step (a) (1) includes passing the feed fuel from the inlet port through an unrestricted aperture sized to pass sufficient feed fuel through the inlet passages to fill the pumping chambers in the charging phase during operation of the engine in the low speed range, and the step (c) (1) includes modulating a time interval during which the aperture is open such that the charging flow quantity varies to prevent the pumping chamber from filling in the charging phase, thereby decreasing the quantity of high pressure fuel delivered to the discharge passage in the discharge phase per engine revolution, with increasing speed above said transition.

8. The method of claim 1, wherein the step (a) (1) includes passing the feed fuel from the inlet port through a fixed, calibrated orifice sized to pass sufficient feed fuel through the inlet passages to fill the pumping chambers in the charging phase during operation of the engine in the low speed range, and the step (c) (1) includes passing the feed fuel through said orifice such that flow resistance of the orifice prevents the pumping chamber from filling in the charging phase, thereby monotonically decreasing the quantity of high pressure fuel delivered to the discharge passage in the discharge phase per engine revolution, with increasing speed above said transition.

9. The method of claim 8, wherein the supply pump has a maximum quantity delivery rate per engine revolution, corresponding to full filling of the pumping chambers, the engine has a maximum speed corresponding to wide open throttle (WOT) and a fuel quantity demand per engine revolution corresponding to WOT, that is less than said pump maximum delivery rate per engine revolution, and the orifice is calibrated such that the quantity of high pressure fuel discharged into the discharge passage per engine revolution at the maximum engine speed, is greater than the fuel quantity demand per engine revolution corresponding to WOT, but no greater than about 75% of the pump maximum quantity delivery rate per engine revolution.

10. The method of claim 9, wherein the engine has a speed corresponding to the engine maximum torque, which is lower than the speed corresponding to WOT, and a fuel demand per engine revolution corresponding to the maximum torque that is less than said pump maximum delivery rate per engine revolution, and the method further comprises reducing the pressure of the feed fuel delivered to the pump inlet port when the engine speed is above the transition speed but below the speed corresponding to WOT.

11. The method of claim 1, wherein steps (b) and (d) include exposing the fuel in the discharge line to a hydro/mechanical pressure limiting valve having a back side in fluid communication with the inlet port and a variable accumulator volume whereby pressure transients resulting from small excess quantities of pumped fuel are absorbed within the accumulator volume without fluid transfer through the back side of the valve, and pressure transients resulting from large excess quantities of pumped fuel are relieved by exposure to the low pressure sink pressure of the inlet port.

12. The method of claim 1, wherein an inlet sump cavity is situated within the pump between the inlet port and the inlet passageways for the pumping chambers, and the steps (a) (1) and (c) (1) are performed between the inlet sump and pumping chambers.

13. The method of claim 1, wherein the inlet passageways to the pumping chambers include calibrated orifices through the piston chamber walls, for delivering of feed fuel during the charging phase.

14. The method of claim 1, wherein the pistons are anti-cavity shuttle pistons.

15. The method of claim 1, wherein steps (b) and (d) include electronically controlling the rail target pressure.

16. The method of claim 11, wherein steps (b) and (d) include controlling the target rail pressure by adjusting the pressure differential at which the pressure limiting valve opens.

17. A high pressure fuel supply pump for receiving fuel from a fuel tank at low feed pressure discharging high pressure fuel to a common rail for delivery to an internal combustion engine having a plurality of combustion cylinders and a respective plurality of fuel injectors fluidly connected to the common rail for injecting fuel into the cylinders at the pressure of the common rail for operating the engine at speeds ranging from cranking speed to a maximum speed, said pump comprising:

a housing, a pump shaft situated within the housing, a plurality of radial pistons mounted for reciprocation in respective pumping chambers and for actuation by the engine at a pump speed proportional to the engine speed;

an inlet port for receiving feed fuel at said feed pressure, and inlet passages fluidly connected in parallel between the inlet port and the pumping chambers for delivering feed fuel to the pumping chambers during a charging phase of operation;

a discharge port for discharging high pressure fuel to the common rail, and discharge passageways from the pumping chambers to the discharge port for delivering high pressure fuel from the pumping chambers during a pumping phase of operation;

a pressure regulator for fluidly connecting the discharge passageways to the inlet passageways to divert at least some high pressure discharged fuel to low pressure feed fuel when the discharge pressure exceeds a limit value and for maintaining full discharge flow from the discharge passageways to the outlet port when the discharge pressure is below said limit value; and means situated between the inlet port and the parallel fluid passages, for restricting the flow of feed fuel through the inlet passages to the pumping chambers when the pump speed exceeds a predetermined threshold value.

18. The pump of claim 17, wherein the means for restricting the flow of feed fuel includes an electronic control unit that generates a feed fuel control signal responsive to engine speed.

19. The pump of claim 18, wherein the includes an electronically controlled valve responsive to said control signal.

20. The pump of claim 18, wherein the means for restricting the flow of feed fuel consists of a calibrated flow orifice.

21. The pump of claim 18, wherein the pistons include an anti-cavitation chamber inside of each pumping plunger piston, formed by a coaxial cylindrical cavity and a loose pin such that during the charging event the anti-cavitation chamber and the main pumping chamber are both fully filled to a degree depending on the relationship between sump pressure P2 and modulated charging pressure P1, whereby before high pumping pressure can be generated the fuel in the anti-cavitation chamber must expelled.

* * * * *